United States Patent [19]

Jones

[11] Patent Number: 4,846,290

[45] Date of Patent: Jul. 11, 1989

[54] UNDERREAMER WITH REVOLVING DIAMOND CUTTER ELEMENTS

[75] Inventor: Kenneth W. Jones, Kingwood, Tex.

[73] Assignee: Smith International, Inc., Houston, Tex.

[21] Appl. No.: 207,684

[22] Filed: Jun. 16, 1988

Related U.S. Application Data

[63] Continuation-in-part of Ser. No. 39,344, Apr. 15, 1987, Pat. No. 4,751,972.

[30] Foreign Application Priority Data

| | | | |
|---|---|---|---|
| Mar. 13, 1987 | [AU] | Australia | 69985/87 |
| Mar. 13, 1987 | [EP] | European Pat. Off. | 87301/802 |
| Mar. 13, 1987 | [MX] | Mexico | 5580 |
| Mar. 13, 1987 | [NO] | Norway | 871037 |

[51] Int. Cl.[4] ..... E21B 10/32

[52] U.S. Cl. ..... 175/269; 175/273; 175/286; 175/287; 175/329

[58] Field of Search ..... 175/269, 273, 286, 287, 175/288, 289, 292, 329

[56] References Cited

U.S. PATENT DOCUMENTS

| | | | |
|---|---|---|---|
| 2,771,275 | 11/1956 | Ortloff | 175/287 X |
| 2,822,149 | 2/1958 | Kammerer, Jr. | 175/286 |
| 3,224,507 | 12/1965 | Cordary et al. . | |
| 3,575,245 | 4/1971 | Cordary et al. . | |
| 3,712,854 | 1/1973 | Thometz et al. . | |
| 3,817,339 | 6/1974 | Furse . | |
| 3,949,820 | 4/1976 | Furse . | |
| 4,055,226 | 10/1977 | Weber . | |
| 4,064,951 | 12/1977 | Weber . | |
| 4,091,883 | 5/1978 | Weber . | |
| 4,282,941 | 8/1981 | Perkin . | |
| 4,282,942 | 8/1981 | Longmore . | |
| 4,589,504 | 5/1986 | Simpson | 175/267 |

*Primary Examiner*—William P. Neuder

*Attorney, Agent, or Firm*—Robert G. Upton

[57] ABSTRACT

A sub-surface borehole underreamer is disclosed having freely rotatable precessing diamond cutters attached to extendable arms connected to the body of the underreamer. The diamond cutting face is skewed to a degree that tangential contact of the peripheral edge of the diamond cutter causes the rotating cutter to precess as the underreamer body is rotated by a drill string.

11 Claims, 1 Drawing Sheet

UNDERREAMER WITH REVOLVING DIAMOND CUTTER ELEMENTS

CROSS-REFERENCE TO RELATED APPLICATION

This application is a continuation-in-part of a copending application, Ser. No. 039,344, filed Apr. 15, 1987 now U.S. Pat. No. 4,751,972.

BACKGROUND OF THE INVENTION

1. Field of the Invention

This invention relates to sub-surface borehole underreamers. More particularly, the invention relates to underreamers having large revolving diamond cutter elements that precess as the underreamer body rotates in a borehole.

2. Description of the Prior Art

A sub-surface borehole underreamer is a tool which is used to enlarge a portion of the length of a hole drilled in the earth below a restriction in the hole. Such tools are used in drilling oil, gas, water, mining, and construction holes in wells, and also in the formation of shotholes for blasting. An underreamer has two operative states, a collapsed or closed state in which the tool diameter is sufficiently small to allow it to be moved in the hole past a restriction, and an opened or expanded state in which the diameter of the tool corresponds to the desired and greater diameter to which the hole is to be enlarged below the restriction. As the tool is opened, one or more arms, hinged at their upper ends to the tool body and carrying suitable cutters at their lower ends, pivot out from the body to position the cutters for engagement of the borehole wall as the tool is thereafter operated; such operation includes rotating the tool and lowering it as it is rotated.

Underreamers are of two basic types, the so-called rock-types and drilling types. Rock-type underreamers are used where the entire length of the borehole, at least over the length thereof to be underreamed, has previously been drilled. Rock-type underreamers have large cutters which extend in the body to its center when the tool is closed; in such tools, it is not required that a circulating fluid flow axially through the tool from end-to-end. In drilling type underreamers it is required that a circulating fluid, such as air or liquid, flow from end-to-end when it is opened. Drilling type underreamers, therefore, use smaller cutters which when the tool is closed do not fully extend to the center or axis of the tool, thereby providing room in the tool for the definition of a circulating fluid duct past the retracted position of the cutters. In a drilling type underreamer the cutters are located between the exterior of the circulation duct and the exterior of the tool body when the tool is closed. Rock-type underreamers, therefore, enable a hole of given diameter to be enlarged to a greater diameter than do drilling type underreamers due to the fact that they incorporate larger cutters within the interior of the tool body than a drilling type underreamer.

A drilling type underreamer is primarily used in conjunction with a drill bit below the underreamer. The underreamer is a lower component of a string of rotary drill pipe and the drill bit is carried at the lower most end of the string. The drill bit forms the hole to be underreamed at the same time that the underreamer enlarges the hole formed by the bit. Circulating of fluid or "mud" must be provided to the drilling bit to remove cuttings and to cool the bit as a bit is operated in a borehole.

Existing rock-type underreamers enable the use of the largest possible roller cutter within the confines of the tool body and they afford maximum expanded diameter of the borehole for a given size of the tool body. Most rock-type underreamers, while they ream larger diameter holes, do not provide any communication of circulating fluid below the tool. On the other hand drilling type underreamers, while they provide fluid communication below the tool, do not provide large underreamed holes adjacent the boreholes. A U.S. Pat. No. 4,282,941 assigned to the same assignee as the present application, solves the problem of providing large cutters for large underreamed holes while at the same time providing a means to circulate fluid past the large cutters to a drill bit positioned at the lower most end of the drill string. The foregoing patent is hereby incorporated by reference.

Yet another prior art U.S. Pat. No. 4,282,942 assigned to the same assignee as the present invention and also incorporated by reference provides an underreamer apparatus that is useful in reverse circulation type drilling operations.

While both of these prior art patents have been successfully operated in the "oil patch" over the years, the large rotary cutters tend to have a limited life as they work in a borehole.

The present invention proposes to replace the state-of-the-art cutter cones which are normally steel body cones with tungsten carbide inserts inserted within interference holes formed by the cone with diamond type cutting elements. The diamond cutters are oriented on each extendable arm such that they precess as they contact a borehole wall thereby, exposing diamond cutting material to the borehole wall continuously as the underreamer is rotated in the borehole by the drill string. The use of diamond cutters in a rotary cone works especially well if the diamond material is prevented from over-heating due to prolonged contact of the diamond material against the borehole wall. The rotary cutter is freely rotatable on a bearing shaft cantilevered from the end of the extendable underreamer arm. As the underreamer body rotates, the cone precesses while it contacts the borehole wall, thus exposing new diamond continuously as the cutter cone rotates about its journal bearing.

SUMMARY OF THE INVENTION

It is an object of this invention to provide an underreamer apparatus with diamond rotary cutters to prolong the cutting life of the underreamer as it works in a borehole.

It is another object of this invention to provide diamond rotary cones cantilevered from bearings extending from extendable arms from the underreamer, such that as the underreamer is rotated in the borehole, the diamond rotary cutters precess as the underreamer rotates thus, continuously exposing uncontacted diamond as the underreamer body turns in the borehole.

A borehole underreamer is disclosed which has a tubular body adapted at an upper end thereof for coaxial connection to a rotary drill string. The body forms a central axis therethrough and houses at least a pair of extendable cutter arms hinged at a first upper end to the tubular body. The cutter arms at a second cutting end form bearing means for a rotary cutter element adapted for rotation thereon. The body of the underreamer further contains means to extend the cutter arms. A cutter element is rotatably attached to the end of each of the cutter extendable arms. Each cutter element forms journal means mounted for rotation relative to the bearing means extending from each of the cutter arms. Each cutter element forms a cutting face. The cutting face is skewed at an angle from a radial line extending from the central axis of the tubular body. The skewed cutter element thus precesses as the cutting face contacts a wall formed by a borehole formation.

The bearing means formed by th cutting end of the cutter arms consists of an aperture formed in the end of the cutter arm. The journal means formed by each of the cutter elements consists of a shaft which extends through the aperture formed by the end of the cutter arm. The cutting face of the cutter element is affixed to one end of the bearing shaft. The cutting face of the cutter element is skewed such that the side nearest the central axis of the tubular body extends further forward than the side of the cutter element which is remote from the central axis of the tubular body. The face of the cutting element is formed preferably of a diamond material such as polycrystalline diamond.

An advantage then, of the present invention over the prior art is the use of diamond cutting material to ream the borehole wall formed in an earth formation.

Yet, another advantage of the present invention over the prior art is the method in which the cutters are skewed such that the cutters precess as the underreamer body is rotated in a borehole. Processing of the diamond cutter element prevents degradation of the diamond cutter through prolonged contact of the cutter with the borehole wall, which results in overheating of the diamond.

The above-noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
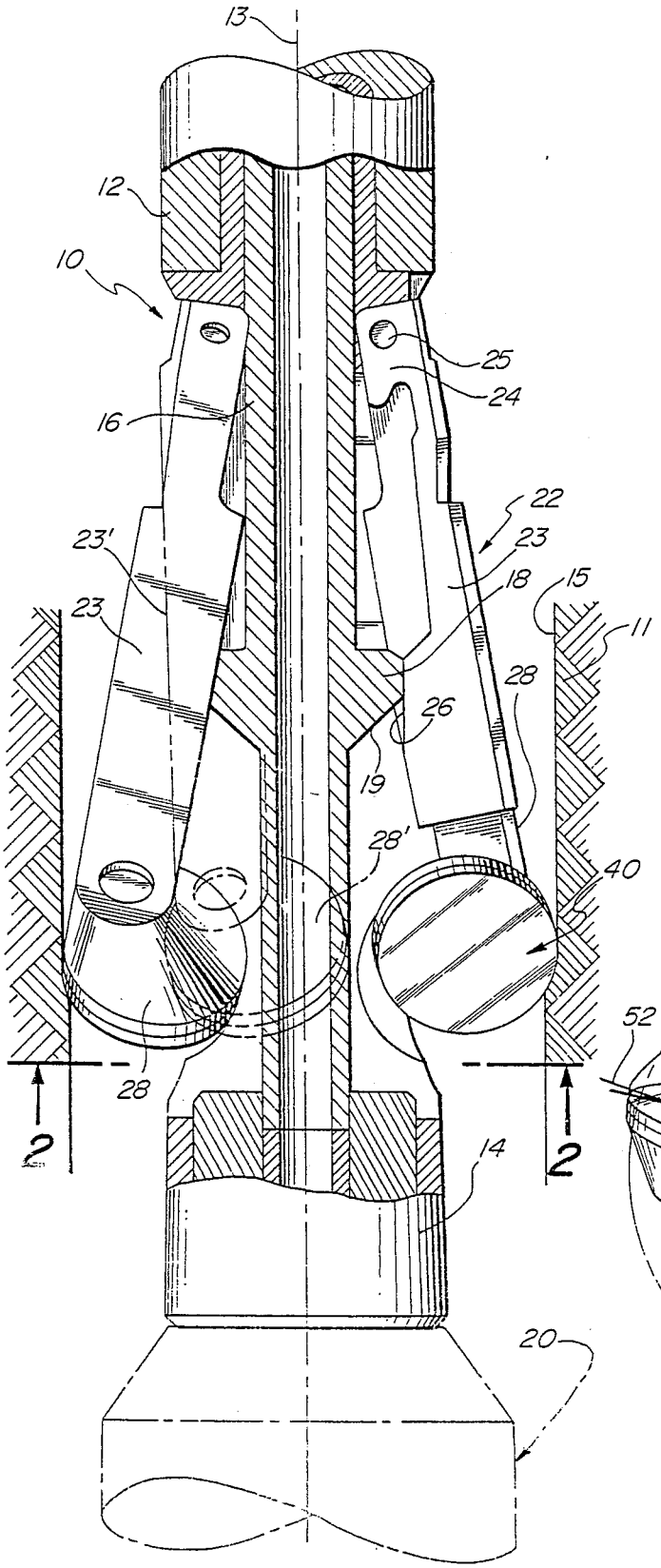
FIG. 1 is a partially cutaway cross-section of a typical expandable underreamer apparatus illustrating the cutter arms extended against a borehole wall with a phantom view of one of cutters in the retracted position.

Referring now to the preferred embodiment of FIG. 1 an underreamer apparatus generally designated as 10 consists of underreamer body 12 which defines a central axis 13 that passes through a base end 14 of the body 12. The underreamer apparatus 10 generally is inserted into a previously drilled borehole in a formation 11. The formation 11 forms borehole wall 15.

A rotary cone rock bit generally designated as 20 may be threadably attached to base end 14 of underreamer 10. (Shown partially in phantom.)

Reamer cutter arms generally designated as 22 are attached at their upper end 24 by a pivot pin 25. An axially slidable mandrel 16 has formed on its exterior, a cam 18 which forms cam surfaces 19. The underside of the cutter arms form a cam surface 26. As the mandrel 16 is moved downwardly, the cam 19 forces the extendable arms outwardly against the borehole wall 15. The end 28 of the cutter arm 22 forms a bearing aperture 30. (Shown more readily in FIG. 3.) The end 28 additionally forms a concave conical bearing surface 32 which is so configured to provide essentially a radially disposed support for the diamond cutter generally designated as 40.

Figure 3:
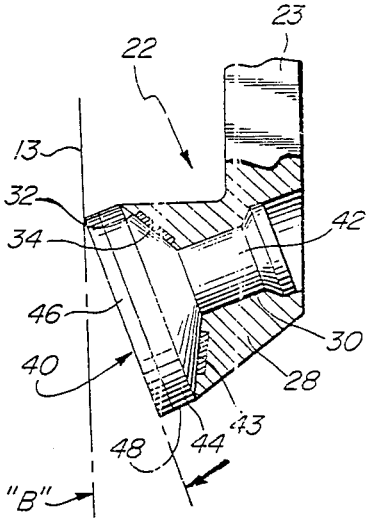
FIG. 3 partially cutaway cross-section of the end of an extendable arm illustrating the diamond cutter rotatably secured to the end of the cutter arm.
Figure 2:
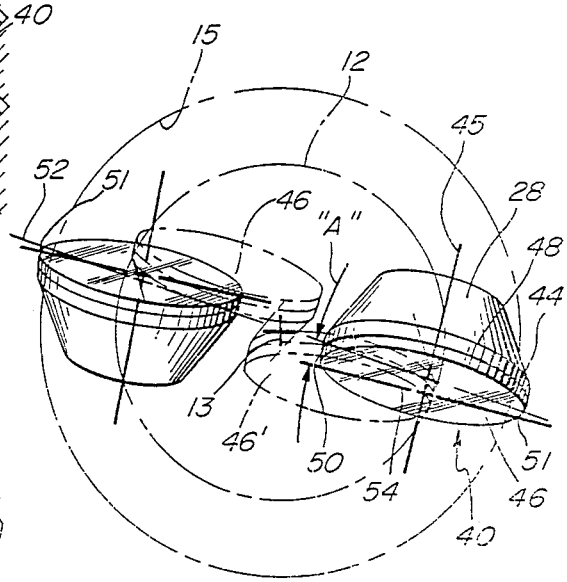
FIG. 2 is a view taken through 2-2 of FIG. 1 illustrating the diamond cutters extended out against a borehole wall with the plane of the cutter being skewed with respect to a line extending from the central axis of the underreamer body.

Referring now to FIGS. 2 and 3, the diamond cutter 40 consists of a bearing journal or shaft 42, conical bearing surface 43 and a cylindrically shaped diamond backup support 44. The backup support and journal is preferably fabricated from tungsten carbide. A diamond disc 46, preferably formed of polycrystalline diamond material is metallurgically attached at 48 to disc backup support 44. A diamond bearing material 34 may be provided in either the concave conical surface 32 in the end 28 or the diamond material may be formed in the conical surface 43 of rotary element 40 (not shown). A shaft retainer 49 is attached to the end of shaft 42 to rotatively retain the cutter element within the end 28 of extendable arm 23. The diamond cutter element freely rotates on shaft 42 as the reamer works in a borehole. The face of the cutter element 46 is also preferably angled "B" with respect to the vertical axis 13 of the body 12. The angle may be from five to forty-five degrees.

It would be obvious to provide conventional roller, ball or friction type bearings between the cutter element 40 and the end 25 of cutter arm 23 without departing from the teachings of this invention.

Referring, specifically now, to FIG. 2, each of the rotatable cutters 40 have their cutting faces aligned such that the plane of the cutting face is skewed from a radial line 52 taken from the axis 13 of bit body 12. Angle "A" represents the skewed surface or plane of the polycrystalline diamond disc 46 with respect to radial line 52. By skewing the surface of the diamond disc 46 (represented by the minor axis 54) the diamond disc 46 is caused to precess as it contacts the borehole wall 15 while the bit body 12 is being rotated in the borehole.

The bearing 30 formed in the end 28 of the arms 23 is angled such that a periphery of the disc 46 taken about 90 degrees from an axis 45 of the rotary disc 46 is offset from the radius 52 of the underreamer body a sufficient distance to assure that the cutter wheel 40 rotates due to a tangential force on the cutter wheel as the drill bit is rotated around its axis 13 within the borehole.

The cutting face of the polycrystalline diamond disc 46 is skewed such that the side of the cutting disc 50 nearest the central axis 13 of the tubular body 12 extends further forward than the side of the cutting disc 51 remote from the central axis 13 of bit body 12. The cutter wheel 40 is offset a sufficient distance so that the cutter wheel rotates in the range of from one-twentieth to one-half revolution for every revolution of the underreamer body. Moreover, the skew angle "A" may be in the range of from ten degrees to sixty degrees. The preferred range, however, is from twenty to thirty degrees.

The diamond disc 46 (shown in phantom) illustrates the diamond cutters in their retracted position confined within the outer diameter of the underreamer body 12.

It would be obvious to provide a diamond cutter other than a disc of polycrystalline diamond material.

For example: the diamond cutter could be a tungsten carbide disc with a multiplicity of equally spaced diamond cutters mounted in the peripheral edge of the tungsten carbide disc. (Not shown.)

Moreover, it would be obvious to provide a torroidally shaped cutting element the outer rounded peripheral surface having a multiplicity of diamond chips embedded within a matrix. The planer surface of this type of cutter would be skewed in a manner heretofore described. (Not shown.)

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A borehole underreamer having a tubular body adapted at an upper end thereof for coaxial connection to a rotary drill string, said body forming a central axis therethrough, said body housing at least a pair of extendable cutter arms hinged at a first upper end to said tubular body, said cutter arms, at a second cutting end, forming bearing means for a rotary cutter element adapted for rotation thereon, said bearing means formed by said cutting end of said cutter arms comprises an aperture formed in said cutter end, said journal means formed by said cutter element comprises a shaft extending through the aperture, with the cutting face being at one end of the shaft, said body further containing means to extend said cutter arms, said underreamer comprising:

at least a pair of cutter elements, said cutter elements forming journal means mounted for rotation relative to said bearing means extending from said cutter arms, said cutter element forming a cutting face, the cutting face being skewed at an angle from a radial line from said central axis of said tubular body so that the cutter element precesses as the cutting face contacts a borehole formation said cutting face is skewed so that the side nearest the central axis of the tubular body rotation extends further forward than the side remote from the central axis said cutter elements rotate when said cutter arms are extended so that said cutters move against a formation wall formed by said formation, said arms are actuated by said arm extension means contained within said tubular body.

2. A borehole underreamer as set forth in claim 1 wherein the cutting face is skewed from a radial line extending from said central axis of said underreamer body a sufficient distance that the cutter rotates in the range from one-twentieth to one-half revolution for every revolution of the underreamer body.

3. The borehole underreamer as set forth in claim 2 wherein said cutting face is skewed from a radial line extending from said central axis of said body in a range of from ten degrees to sixty degrees.

4. The borehole underreamer as set forth in claim 3 wherein said cutting face is skewed from in a range of from twenty degrees to thirty degrees.

5. A borehole underreamer as set forth in claim 4 wherein said cutting face is comprised of a diamond material.

6. A borehole underreamer as set forth in claim 5 wherein said diamond material is a disc of polycrystalline diamond metallurgically bonded to a cutter element base forming said journal means.

7. A borehole underreamer as set forth in claim 6 wherein said cutter element base is comprised of tungsten carbide.

8. A borehole underreamer as set forth in claim 7 wherein said cutter element base forms a conical journal bearing surface that conforms to a matching concave conical bearing surface formed by said second cutting end of said extendable arms.

9. A borehole underreamer as set forth in claim 8 wherein said disc of polycrystalline diamond is metallurgically boned to said tungsten carbide cutter element base.

10. A borehole underreamer as set forth in claim 9 wherein a diamond bearing surface is formed in said concave conical bearing surface formed in said second end of said extendable arm thereby providing a diamond bearing between said matched tungsten carbide conical surface formed by said cutter element.

11. A borehole underreamer as set forth in claim 10 wherein said diamond bearing is fabricated from polycrystalline diamond material.

* * * * *